US006774863B2

(12) United States Patent
Shirosaka et al.

(10) Patent No.: US 6,774,863 B2
(45) Date of Patent: Aug. 10, 2004

(54) ANTENNA SYSTEM

(75) Inventors: Toshiaki Shirosaka, Kobe (JP); Kiyotaka Tatekawa, Kobe (JP); Eiji Shibuya, Kobe (JP); Shingo Fujisawa, Kobe (JP); Shotaro Horii, Kobe (JP)

(73) Assignee: DX Antenna Company, Limited, Kobe (JP)

( * ) Notice: Subject to any disclaimer, the term of this patent is extended or adjusted under 35 U.S.C. 154(b) by 0 days.

(21) Appl. No.: 10/357,835

(22) Filed: Feb. 3, 2003

(65) Prior Publication Data

US 2004/0102221 A1 May 27, 2004

(30) Foreign Application Priority Data

Nov. 21, 2002 (JP) ..... 2002-338050

(51) Int. Cl.[7] ..... H01Q 21/26
(52) U.S. Cl. ..... 343/797; 343/757; 343/893
(58) Field of Search ..... 343/797, 853, 343/718, 757, 850, 860, 893, 727

(56) References Cited

U.S. PATENT DOCUMENTS 4,334,230 A * 6/1982 Kane ..... 343/797
6,498,589 B1 12/2002 Horii ..... 343/727
6,518,931 B1 * 2/2003 Sievenpiper ..... 343/770
2002/0028666 A1 * 3/2002 Nakagawa et al. ..... 455/193.1

* cited by examiner

*Primary Examiner*—Don Wong
*Assistant Examiner*—Thuy Vinh Tran
(74) *Attorney, Agent, or Firm*—Duane Morris LLP

(57) ABSTRACT

Antennas (8*a*–8*d*) are disposed within an antenna body (2) of an antenna system in such a manner as to receive UHF band radio waves coming to the main body (2) from a plurality of first, different directions around the main body (2). Combinations of the antennas (8*a*–8*d*) makes the antenna system possible to receive UHF band radio waves coming to the main body (2) from a plurality of second, different directions between adjacent ones of the first directions. Switches (26*a*–26*d*) disposed within the main body (2) select one of outputs provided by the individual antennas (8*a*–8*d*) and their combinations. An antenna controller (64*a*), a unit separate from the main body (2), supplies a selection control signal to the switches (26*a*–26*d*). The antenna controller (64*a*) provides such a selection control signal as to successively select the direction of the radio wave to be received in the clockwise direction about the main body (2) each time a first operating element (88*a*) on a remote control (64*b*) is operated, and provides such a selection control signal as to successively select the direction of the radio wave to be received in the counterclockwise direction each time a second operating element (88*b*) on the remote control (64*b*) is operated.

12 Claims, 11 Drawing Sheets

ANTENNA SYSTEM

This invention relates to an antenna system and, more particularly, to an antenna system including a plurality of antennas which can be combined in various ways to provide a variety of directivities for the antenna system.

BACKGROUND OF THE INVENTION

A prior antenna system of this type is disclosed in, for example, Japanese Patent Application Publication No. 2001-36327 A laid open for public inspection on Feb. 9, 2001, which corresponds to U.S. Pat. No. 6,498,589 which issued on Dec. 24, 2002 to S. Horii, one of the co-inventors of the present application, and assigned to the same assignee of the present application.

The antenna system disclosed in the above publication includes four unit antennas A, B, C and D which are oriented differently in such a manner that the directivity of each unit antenna is angularly spaced by 90° from adjacent antennas. Selecting means is provided to select one of outputs of the individual unit antennas and adjacent pairs of the unit antennas. A directivity control pulse generator provides a four-bit selection control signal to the selecting means to achieve the selection. The directivity control pulse generator is provided with a directivity selecting switch, which changes the value of the selection control signal cyclically, from, for example, "1000" through "1100", "0100", "0110", "0010", "0011", "0001", and "1001" back to "1000", each time it is operated. In response to such changes of the selection control signal, the output of the antenna system changes from, for example, the output of the unit antenna A, the combined outputs of the unit antennas A and B, the output of the unit antenna B, the combination of the outputs of the unit antennas B and C, the output of the unit antenna C, the combination of the outputs of the unit antennas C and D, the output of the antenna D, and the combination of the outputs of the unit antennas A and D, back to the output of the unit antenna A. In this way, the directivity of the antenna system is successively switched, for example, clockwise about the antenna system.

The directivity control pulse generator of the described antenna system can change the value of the four-bit control signal only in the above-described order. In other words, the switching of the directivity can be done only in one direction. Accordingly, when the directivity of the antenna system is being changed in the prescribed order to select the best directivity for receiving a desired radio wave, it is not possible to return back in the reverse order if the previous directivity is found to be better than the current one, but it is necessary for the four-bit control signal value to lap in the forward direction in the prescribed order to the previous value. Therefore, it has been required some time to attain the best directivity.

In the described antenna system, no correlation is established between the switching of directivity and the frequency of a desired radio wave. If the antenna directivity is different from one radio wave to another, the directivity selecting switch must be operated each time a different radio wave is to be received, in order to select a desired directivity for the antenna system. Therefore, it is troublesome to set the antenna system in the state to obtain the best directivity.

An object of the present invention is to provide an antenna system which can be rapidly set to have a desired directivity.

SUMMARY OF THE INVENTION

In an antenna system according to a first embodiment of the present invention, a plurality of directivities of an antenna system are successively scanned in a desired direction or order in order to find an optimum directivity to receive a desired radio wave. This scanning is done by operating first and second operating elements.

The antenna system according to the first embodiment has an antenna main body. A plurality of first angularly spaced antennas are disposed within the body in such a manner as to provide the antenna system with a plurality of directivities that enable the antenna system to receive radio waves in a first frequency-band coming toward the body from different first directions around the body. Radio waves in the first frequency band may be, for example, radio waves in the UHF band or the VHF band. The radio waves may be television broadcast radio waves in the UHF or VHF band.

By combining the directivities of the first angularly spaced antennas, it is possible to provide the antenna system with a plurality of directivities that enable the antenna system to receive radio waves in the first frequency band coming toward the body from second different directions which are between adjacent ones of the respective first directions.

First selecting means is disposed within the body. The first selecting means operates to select one output from the outputs of the individual ones and combinations of the first antennas.

Control means is provided separate from the main body. The control means provides a selection control signal to the first selecting means. The control means has first and second operating elements. Each time the first operating element is operated, the control means provides such a selection control signal as to successively scan, in the clockwise direction around the main body, the directivities. Each time the second operating element is operated, the control means provides such a selection signal as to successively scan the directivities of the antenna system in the counterclockwise direction around the main body.

Through the operation of the first operating element, the directivity of the antenna system can be successively switched or rotated clockwise, and, through the operation of the second operating element, the directivity can be successively switched counterclockwise. When an operator is switching the directivity successively clockwise, for example, he or she may find that a desired radio wave can be received most efficiently with the previously selected directivity, and, therefore, may try to reverse the directivity scanning direction to the counterclockwise direction. According to the present invention, such reversal is easy.

Level adjusting means may be disposed within the main body for enabling level adjustment of the output from an individual antenna or combination of individual antennas selected by the first selecting means. An amplifier or a variable attenuator, for example, may be used as the level adjusting means. The control means has a third operating element, in addition to the first and second operating elements, which, when operated, provides a signal commanding the level adjusting means to operate in an operating state represented thereby.

With this arrangement, when the radio wave receiving level is too high or too low, the third operating element may be operated to adjust the signal receiving level to an appropriate one.

The control means may include operating means for transmitting an optical signal in response to operation of the operating elements, and transmitting means provided separately from the operating means. The transmitting means receives the optical signal from the operating means and transmits the selection control signal to the main body. The operating means may include the third operating element in addition to the first and second operating elements.

With this arrangement, the operating means with the operating elements can be disposed at a location remote from the transmitting means, which makes it possible to provide remote controlling of the antenna system.

A plurality of second antennas may be disposed within the body, which are arranged to receive radio waves in a second frequency band coming from the first directions to the body. The second frequency band may be the UHF or VHF band, and the radio waves may be television broadcast signals. The second antennas also have respective directivities, which may be combined in various ways to provide the antenna system with directivities that enable the antenna system to receive radio waves coming to the body from the second directions between adjacent ones of the first directions.

Second selecting means is disposed in the body. The second selecting means selects one output from the outputs of individual ones and combinations of the second antennas. The control means provides such selection control signals to the first and second selection means that each time the first operating element is operated, the directivities of the antenna system for radio waves in the first and second frequency bands are successively scanned in the clockwise direction around the body. Each time the second operating element is operated, the directivities for the first and second frequency bands are successively scanned in the counterclockwise direction around the main body.

With this arrangement, radio waves in different frequency bands can be received in an optimum receiving condition.

A transmission path is provided between the body and the control means. Via the transmission path, the output of an individual one of the first unit antennas or an output of a combination of ones of the first unit antennas is transmitted to the control means, and power for operating the level adjusting means is transmitted from the control means to the body. The control means forms the selection control signal in the form of variations of the operating source voltage to be supplied to the transmission path.

Since the selection control signal is formed by changing the source voltage, the circuit can be simplified.

The control means may provide a tone signal as the signal for commanding the level adjusting means to operate.

It would be possible to change the operating source voltage to be transmitted via the transmission path to form a signal which commands the level adjusting means to operate in the manner represented by the signal. However, in such a case, the operating source voltage must be changed for all of the receiving directions, and in order to indicate how the level adjusting means should be operated also by means of changing the operating source voltage, the source voltage must be changed in a very complicated manner. In contrast, by the use of a tone signal in commanding the level adjusting means to operate, the change of the source voltage needs to represent the selection control signal only, which simplifies the circuit.

The control means may include pulse signal generating means which generates a pulse signal in response to operation of the first and second operating element, counting means which counts the number of pulses in the pulse signal, and selecting means operating means which generates the selection control signal determined in accordance with the count in the counting means. The counting means, after it counts a value corresponding to the sum of the number of the first and second directions from which radio waves come, i.e. the number of the UHF (VHF) directivities of the antenna system, desirably has its count returned to the initial value in response to the next pulse applied to it. The pulse signal generating means generates a pulse each time the first operating element is operated, and generates pulses equal in number to the number of the directivities provided by the first antennas (and, hence, second antennas), minus one (1) each time the second operating element is operated.

According to a second embodiment of the present invention, radio wave receiving channels are stored in memory means in association with the directivity of an antenna system, and the directivity of the antenna system is changed in response to a channel selected.

The antenna system according to the second embodiment, too, includes a main body, first antennas, and selecting means. The antenna system is provided with a tuner, which is a discrete unit. The tuner receives and demodulates an output from the selecting means. The tuner may be a television broadcast signal receiving tuner, for example, which may be for handling analog television broadcast and/or digital television broadcast signals. The tuner may be built in a television receiver, or a discrete unit.

The tuner includes a memory means, which stores therein selection control signals to be supplied to the selecting means for receiving a radio wave of a desired one of a plurality of broadcast channels in response to selection of that channel. When a desired channel is selected in the tuner, a selection control signal for the selected channel is read out from the memory means and supplied to the selecting means.

When the tuner is operated to designate a desired channel, an antenna or antennas by which the radio wave of the designated channel can be received in an optimum condition is selected. Accordingly, there is no need to separately switch or select the antennas and the channels, which increases workability of the antenna system.

Level adjusting means is disposed in the main body for adjusting the level of the output from an individual unit antenna or a combination of the unit antennas as selected through the selecting means. The level adjusting means may be an amplifier or an adjustable attenuator. In addition to the selection control signals, level control signals indicating the states to which the level adjusting means is to be adjusted are stored in the memory means being correlated with the respective broadcast channels to be received. When the tuner is operated to select a desired channel, the level control signal for the selected channel is read out of the memory means and supplied to the level adjusting means.

With this arrangement, the level adjusting means adjusts the level of the antenna output so as to provide optimum reception of the desired channel.

If the broadcast channels to be received are digital television broadcast channels, the respective selection control signals are determined based on a bit error rate generated by the tuner, and if the broadcast channels to be received are analog television broadcast channels, the selection control signals are determined based on a signal reception level at the tuner.

Whether digital television broadcast waves can be received well or not depends on a bit error rate realizable in a tuner. Whether analog television broadcast waves can be received well or not depends on a received signal level at the tuner. The selection control signals are so determined as to provide an optimum bit error rate and an optimum received signal level.

A transmission path is provided between the main body and the tuner for transmitting an output of an individual unit antenna or a combination of outputs of unit antennas to the tuner. The tuner sends the selection control signals via the transmission path. For sending the selection control signal to the transmission path, modulating means may be provided which outputs a modulation signal formed of a carrier modulated with the selection control signal, and demodulating means may be provided in the body for demodulating the modulation signal back to the selection control signal.

With this arrangement, the selection control signals can be transmitted through the transmission path, no extra transmission paths for the selection control signals are required.

DESCRIPTION OF EMBODIMENTS

Figure 5:
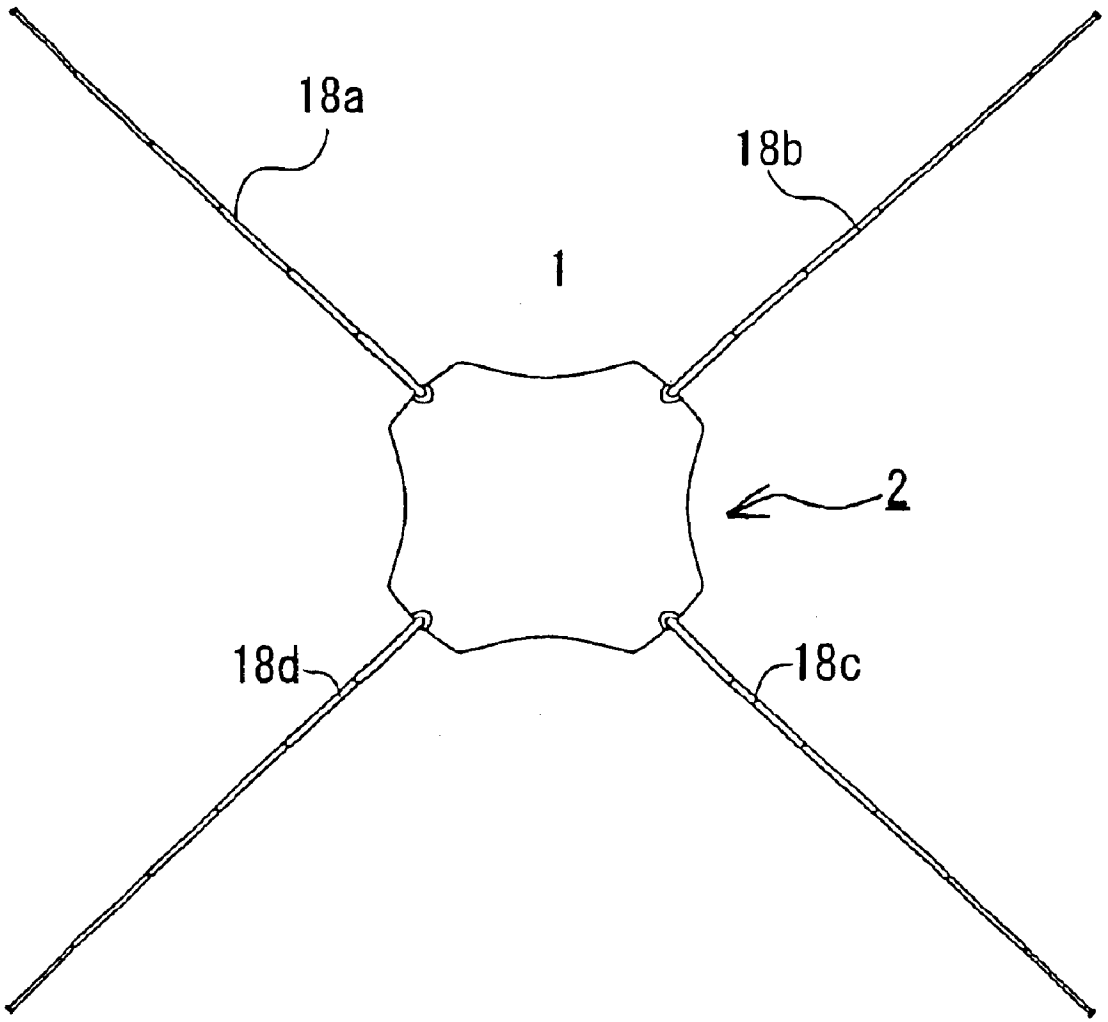
FIG. 5 is a plan view of the antenna system shown in FIG. 1.
Figure 6A:
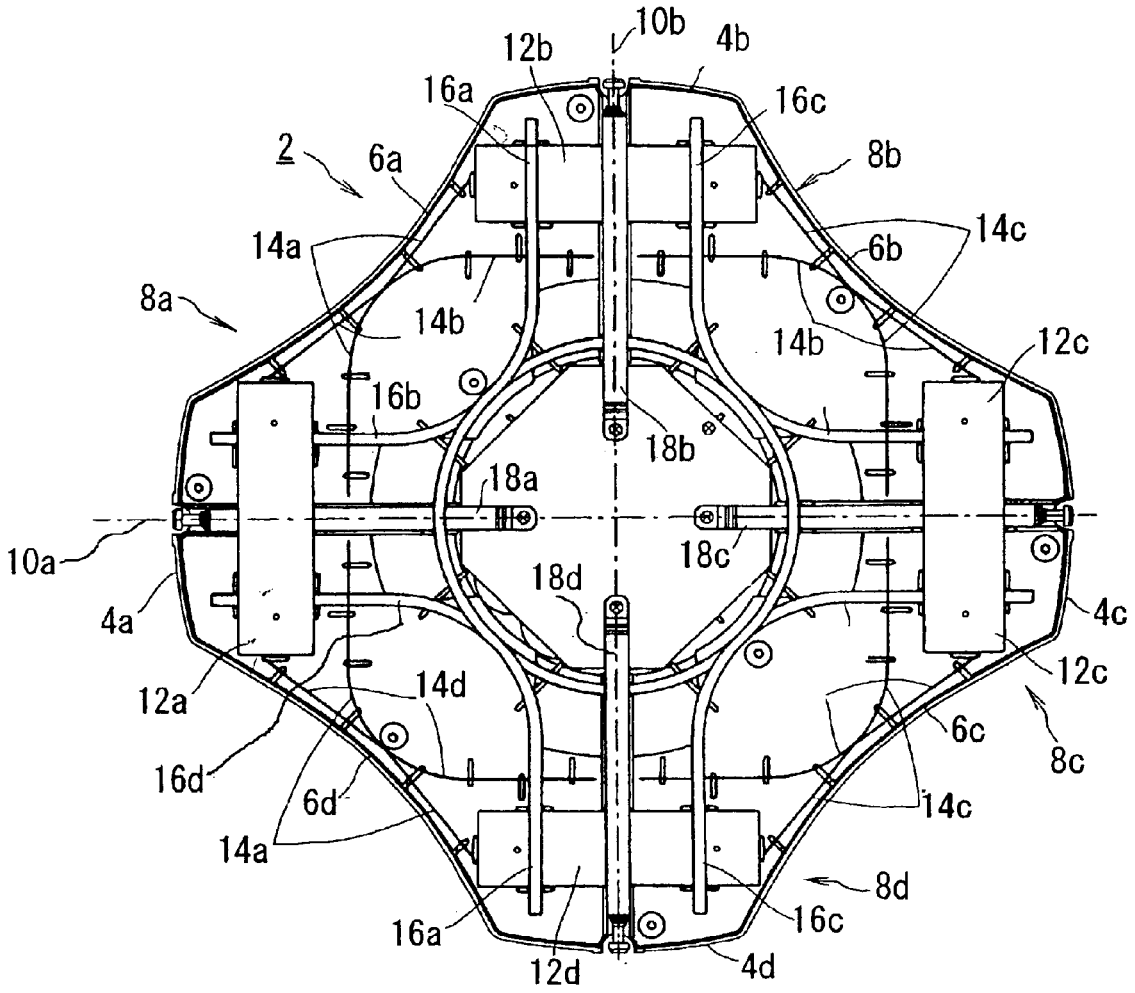
FIG. 6A is a plan view of the antenna system shown in FIG. 5 in which internal components are shown.

An antenna system according to a first embodiment of the present invention is used for receiving television broadcast signals in the UHF and VHF bands, for example, and includes an antenna assembly 1 as shown in FIG. 5. The antenna system has a body 2. The body 2 is generally octagonal and flat in shape. As shown in FIG. 6A, the body 2 has slightly convex sides 4*a*, 4*b*, 4*c* and 4*d*, which are angularly spaced one another by 90°. Between adjacent ones of the convex sides 4*a*–4*d*, the body 2 also has concave sides 6*a*, 6*b*, 6*c* and 6*d*. The concave sides 6*a*–6*d* connect adjacent ones of the convex sides 4*a*–4*d*.

Figure 8:
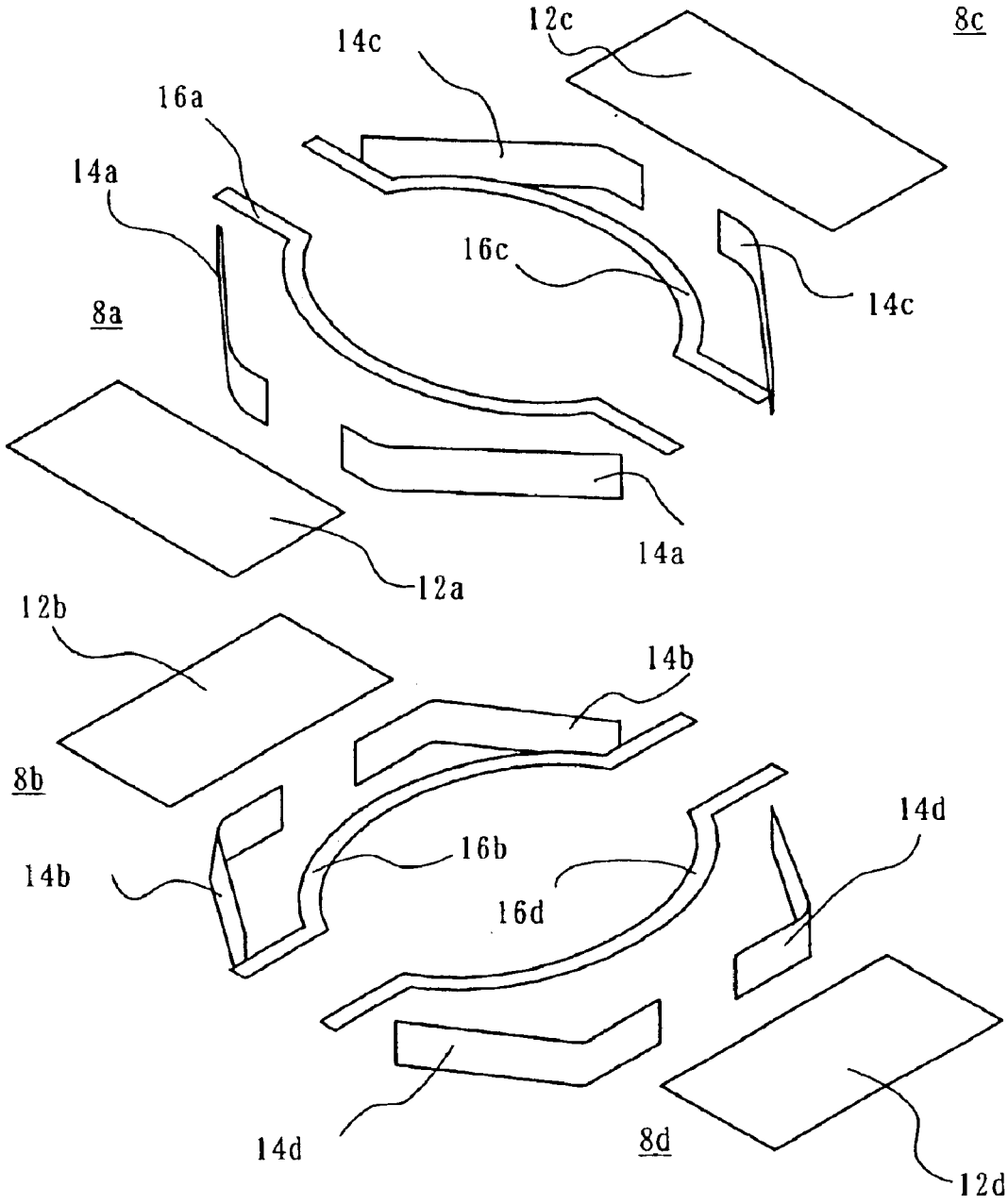
FIG. 8 shows positional relationship of components of the UHF antenna used in the antenna system shown in FIG. 1.

As shown in FIG. 6A, the antenna assembly 1 is disposed within the body 2, and includes a plurality, e.g. four, of Yagi antennas 8*a*, 8*b*, 8*c* and 8*d* for a first frequency band, e.g. the UHF band. The Yagi antennas 8*a*–8*d* are for receiving television broadcast signals in the UHF band of from 470 MHz to 890 MHz, in U.S.A. Two of the four Yagi antennas, e.g. the Yagi antennas 8*a* and 8*c*, are disposed on a line 10*a* connecting the opposing convex sides 4*a* and 4*c*, in one plane, for example, in a horizontal plane. The other two Yagi antennas 8*b* and 8*d* are disposed on a line 10*b* extending orthogonal to the line 10*a* in a horizontal plane at a different level, e.g. below the plane in which the Yagi antennas 8*a* and 8*c* lie. This relationship in position is schematically shown in FIG. 8.

As shown in FIG. 6A, the Yagi antennas 8*a* and 8*c* include directors 12*a* and 12*c*, respectively, which are disposed within the body 2 at locations near the convex sides 4*a* and 4*c*. The directors 12*a* and 12*c* are planar and of the same size. They are disposed with their major surfaces lying horizontal, and their longer sides extending perpendicular to the line 10*a*.

Radiators 14*a* and 14*c* are disposed inward of the directors 12*a* and 12*c*. The radiator 14*a* has feeding points on opposite sides of the line 10*a* and is formed of two elements extending generally perpendicularly to the line 10*a* from the respective feeding points to points near the concave sides 6*a* and 6*d*, respectively, and then curving inward to extend generally along the concave sides 6*a* and 6*d* to points near the convex sides 4*b* and 4*d*.

Figures 7A, 7B, 7C:
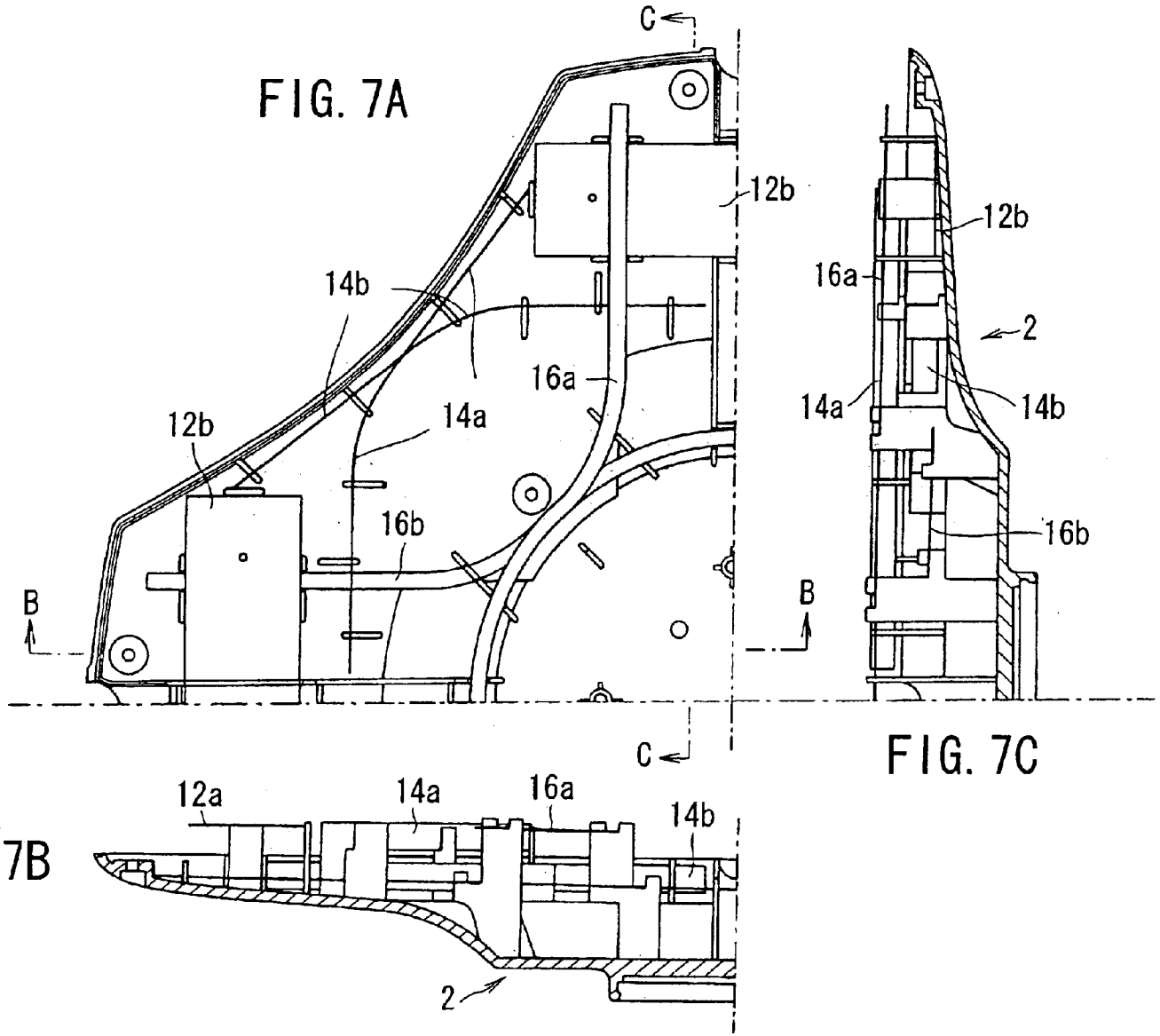
FIG. 7A is an enlarged plan view of a part of the antenna system shown in the fourth quadrant of FIG. 6A.
FIG. 7B is an enlarged view of the left half of the antenna system shown in FIG. 6B.
FIG. 7C is an enlarged view of the upper half of the antenna system shown in FIG. 6C.

The radiator 14*c* is arranged similar to the radiator 14*a*, as shown. Each of the is radiators 14*a* and 14*c* has a shape like an equal-sided trapezoid without base and with a smooth transition from the top to the sides. Bending in this manner, the radiators 14*a* and 14*c* can have a required length in a narrow space within the body 2. The radiators 14*a* and 14*c* are also planar, but, different from the directors 12*a* and 12*c* which have their major surfaces laid horizontal, they are disposed with this major surfaces lying in respective vertical planes. The upper edges of the radiators 14*a* and 14*c* are at substantially the same level as the major surfaces of the directors 12*a* and 12*c*, respectively, as shown in FIG. 7B. The radiators 14*a* and 14*c* are disposed with their major surfaces extending vertically so that they can be easily bent.

Reflectors 16*a* and 16*c* are disposed inward of the radiators 14*a* and 14*c*, respectively. The reflector 16*a* has straight end portions on opposite sides of the line 10*a* and a curved portion connecting the inner ends of the straight end portions. The curved portion is convex toward the director 12*a*. The reflector 16*c* is arranged similar to the reflector 16*c*. Due to this curving configuration, the reflectors 16*a* and 16*c* can have a required length. As shown in FIG. 7B, the reflector 16*a*, and, hence, the reflector 16*c*, are planar with their major surfaces facing horizontally, and their upper edges are flush with the major surfaces of the directors 12*a* and 12*c*, respectively.

The Yagi antennas 8*b* and 8*d* have a structure similar to that of the Yagi antennas 8*a* and 8*c*, and include directors 12*b* and 12*d*, radiators 14*b* and 14*d* and reflectors 16*b* and 16*d*, respectively. The Yagi antennas 8*b* and 8*d* are arranged along the line 10*b* to diametrically face each other. The line 10*b* orthogonally intersects the line 10*a* along which the Yagi antennas 8*a* and 8*c* are arranged. The Yagi antennas 8*b* and 8*d* are disposed at a lower level than the Yagi antennas 8*a* and 8*c* so that the upper and lower level antennas do not contact, as shown in FIG. 8.

The radiators 14*a* and 14*b* intersect without contacting with each other. Also, the radiators 14*b* and 14*c*, the radiators 14*c* and 14*d*, and the radiators 14*d* and 14*a* intersect without contacting each other, respectively, as shown in FIG. 6A. The reflector 16*a* intersects the reflectors 16*b* and 16*d* without contacting, and the reflector 16*c* intersects the reflectors 16*b* and 16*d* without contacting. The reflector 16*a* intersects also the radiators 14*b* and 14*d* and the directors 12*b* and 12*d* without contacting, the reflector 16*b* does the radiators 14*a* and 14*c* and the directors 12*a* and 12*c* without contacting, the reflector 16*c* does the radiators 14*b* and 14*d* and the directors 12*b* and 12*d* without contacting and the reflector 16*d* intersects the radiators 14*c* and 14*a* and the directors 12*c* and 12*a* without contacting.

The four sets of Yagi antennas 8*a*, 8*b*, 8*c* and 8*d* can be disposed in the narrow space of the body 2 by virtue of disposing the radiators, the directors and the reflectors to intersect as described above. The intersection does not cause large disturbance in the characteristics of the Yagi antennas 8*a*–8*d* since the set of antennas 8*a* and 8*c* and the set of antennas 8*b* and 8*d* are disposed at different levels and, therefore, the respective antennas do not interfere with one another. Also, since adjacent ones of the four antennas, e.g. the antennas 8*a* and 8*b*, are at different levels, they hardly interfere with each other.

By virtue of the above-described arrangements of the respective Yagi antennas 8*a*, 8*b*, 8*c* and 8*d*, they can receive radio waves coming from different directions, e.g. radio waves coming into the antenna system from the directions toward the convex sides 4*a*–4*d*. Thus, the Yagi antennas 8*a* through 8*d* constitute a single composite UHF antenna.

Figure 6B:
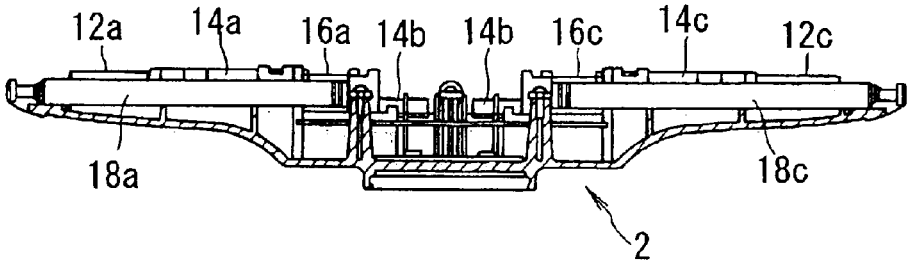
FIG. 6B is a cross-sectional view along the line 10*a* in FIG. 6A.
Figure 6C:
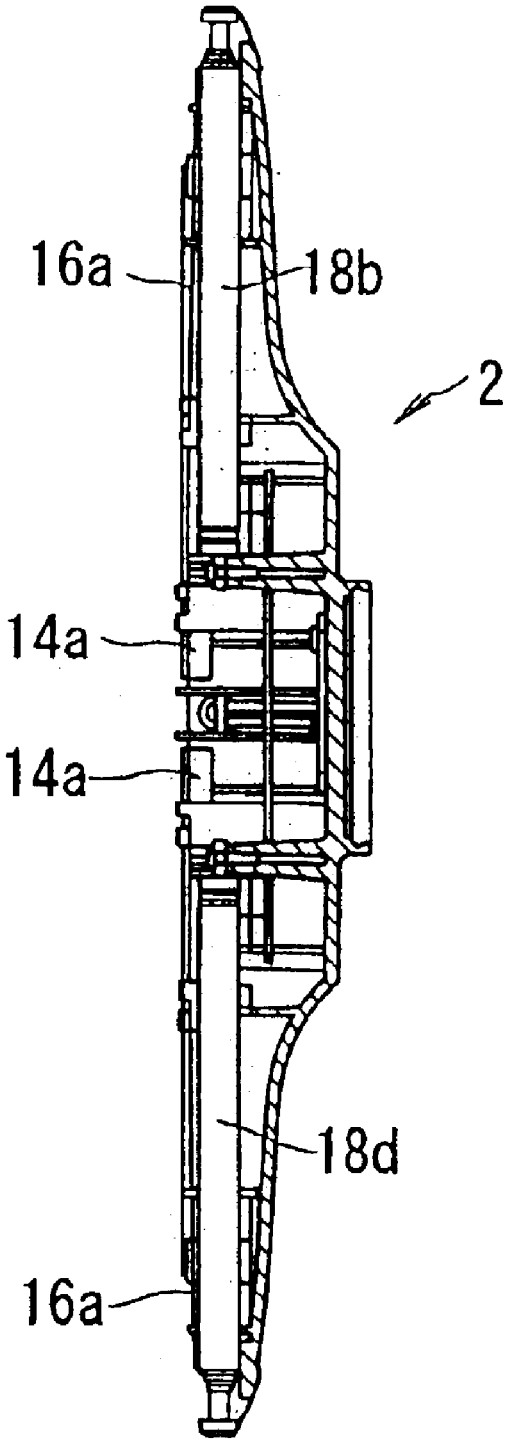
FIG. 6C is a cross-sectional view along the line 10*b* in FIG. 6A.

The antenna assembly 1 includes also an even number greater than four of rod antennas, e.g. four rod antennas 18*a*, 18*b*, 18*c* and 18*d*, disposed within the main body 2. The rod antennas 18*a*–18*d* are arranged in a horizontal plane at a level intermediate the plane in which the Yagi antennas 8*a* and 8*c* are arranged and the plane in which the Yagi antennas 8*b* and 8*c* are arranged. The rod antennas 18*a* and 18*c* are arranged along the line 10*a* in the horizontal plane, and the rod antennas 18*b* and 18*d* are arranged along the line 10*b* in the horizontal plane. The rod antennas 18*a*–18*d* are shown fully retracted in FIGS. 6A, 6B and 6C, and can be extended out from the respective convex sides 4*a*–4*d* to any desired positions between the fully retracted positions shown in FIG. 6A and the fully extended positions shown in FIG. 5.

Figure 9A:
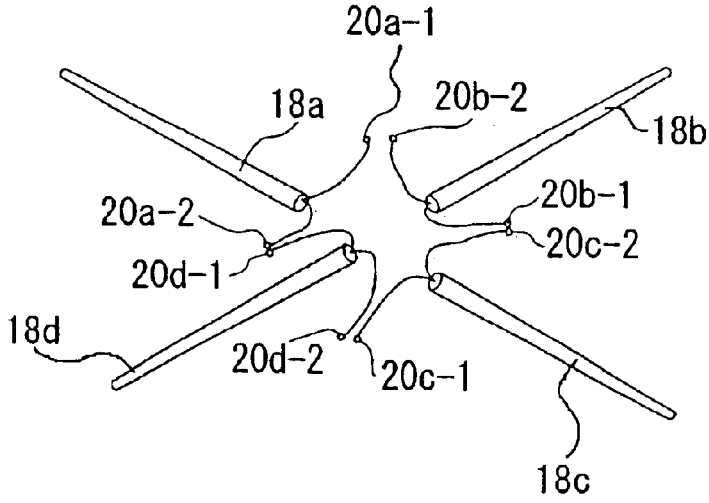
FIGS. 9A and 9B respectively show how V-shaped antennas and dipole antennas are formed of rod antennas used in the antenna system shown in FIGS. 6A, 6B and 6C.
Figure 9B:
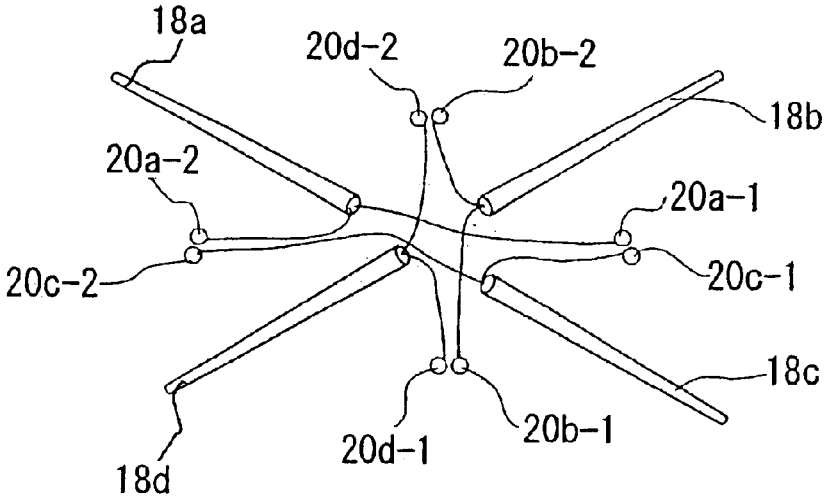

The rod antennas 18*a*, 18*b*, 18*c* and 18*d* are combined to provide the same number, four in the illustrated embodiment, of V-shaped antennas. More specifically, two feed terminals 20*a*-1 and 20*a*-2 are disposed at the innermost end of the rod antenna 18*a*, as shown in FIG. 9A or 9B. Similarly, the rod antennas 18*b*, 18*c* and 18*d* are provided with two feed terminals 20*b*-1 and 20*b*-2, feed terminals 20*c*-1 and 20*c*-2, and feed terminals 20*d*-1 and 20*d*-2, at their respective innermost ends.

As shown in FIG. 9A, the rod antenna 18*a* and the adjacent antenna 18*b* are fed through one of the two feed terminals of the antenna 18*a* and one of the two feed terminals of the antenna 18*b*, for example, through the feed terminal 20*a*-1 and 20*b*-2. Similarly, the adjacent rod antennas 18*b* and 18*c* are fed through the feed terminals 20*b*-1 and 20*c*-2. The adjacent rod antennas 18*c* and 18*d* are fed through the feed terminals 20*c*-1 and 20*d*-2. The feed terminals 20*d*-1 and 20*a*-2 are used to feed the adjacent rod antennas 18*d* and 18*a*.

Alternatively, as shown in FIG. 9B, the two rod antennas arranged on the same line, for example, the rod antennas 18*a* and 18*c* may be used to form a dipole antenna, and the remaining two rod antennas 18*b* and 18*d* on the same line may be used to the other dipole antenna.

Since two feed terminals are disposed on each of the rod antennas 18*a*, 18*b*, 18*c* and 18*d*, two pairs of feed terminals are led out from each dipole antenna. For example, the dipole antenna formed by the rod antennas 18*a* and 18*c* is provided with a pair of feed terminals 20*a*-1 and 20*c*-1 and a pair of feed terminals 20*a*-2 and 20*c*-2. Using these two pairs of feed terminals, a single dipole antenna can be used either of two dipole antennas having mutually opposite directive response characteristics. Thus, although two rod antennas are used to form a single dipole antenna, the same number of dipole antennas as the rod antennas can be effectively provided. The rod antennas 18*a*, 18*b*, 18*c* and 18*d* provide a single composite VHF antenna. The rod antennas 18*a*–18*d* are for receiving television broadcast signals in a frequency band of from 54 MHz to 88 MHz and a frequency band of from 174 MHz to 216 MHz in U.S.A.

The four V-shaped antennas or the four dipole antennas formed by the rod antennas 18*a*, 18*b*, 18*c* and 18*d* are hereinafter referred to as VHF antennas 22*a*, 22*b*, 22*c* and 22*d*. Also, the Yagi antennas 8*a*–8*d* are hereinafter referred to as UHF antennas 8*a*, 8*b*, 8*c* and 8*d*, respectively.

Figure 1:
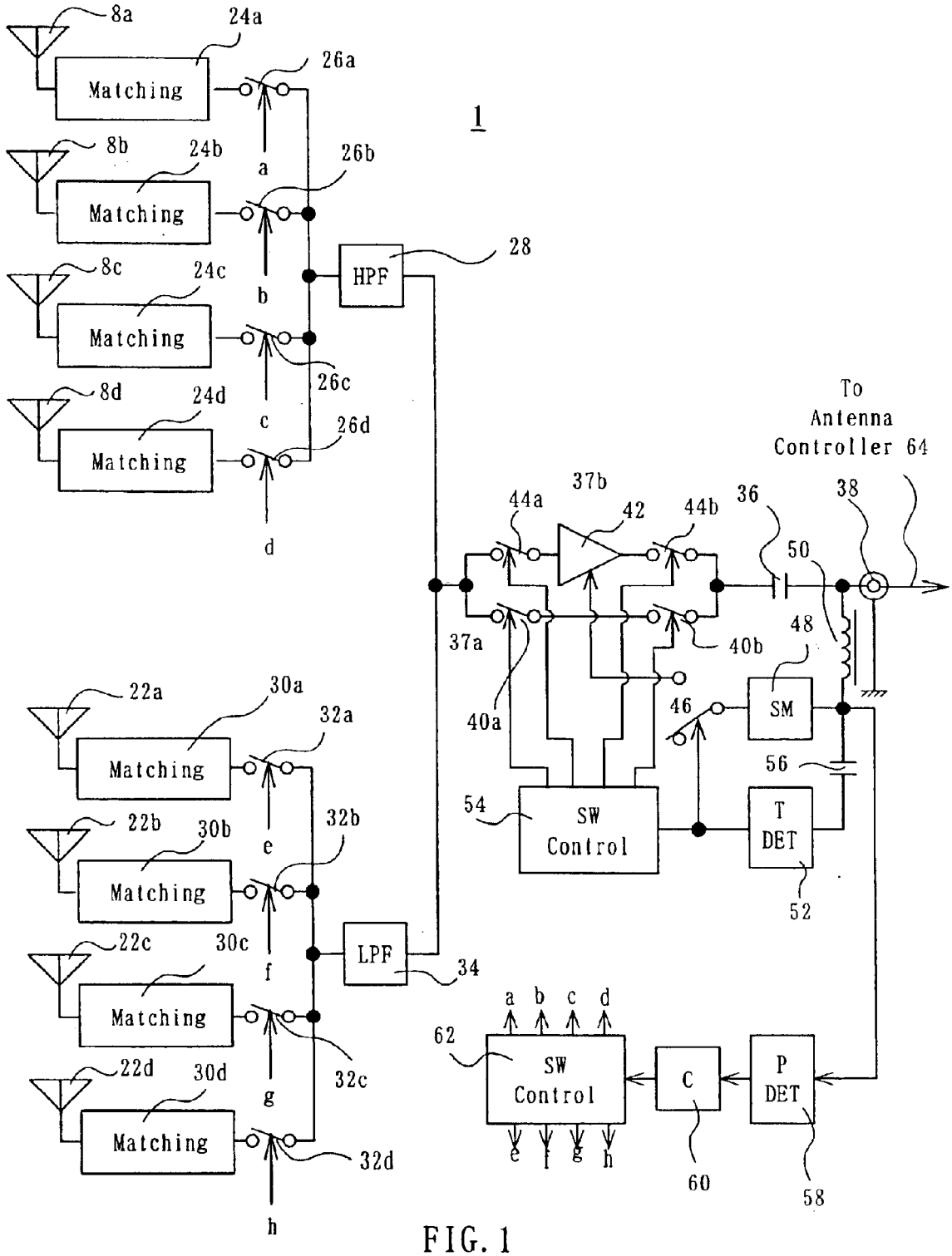
FIG. 1 is a block diagram of antennas of an antenna system according to a first embodiment of the present invention.
Figure 2:
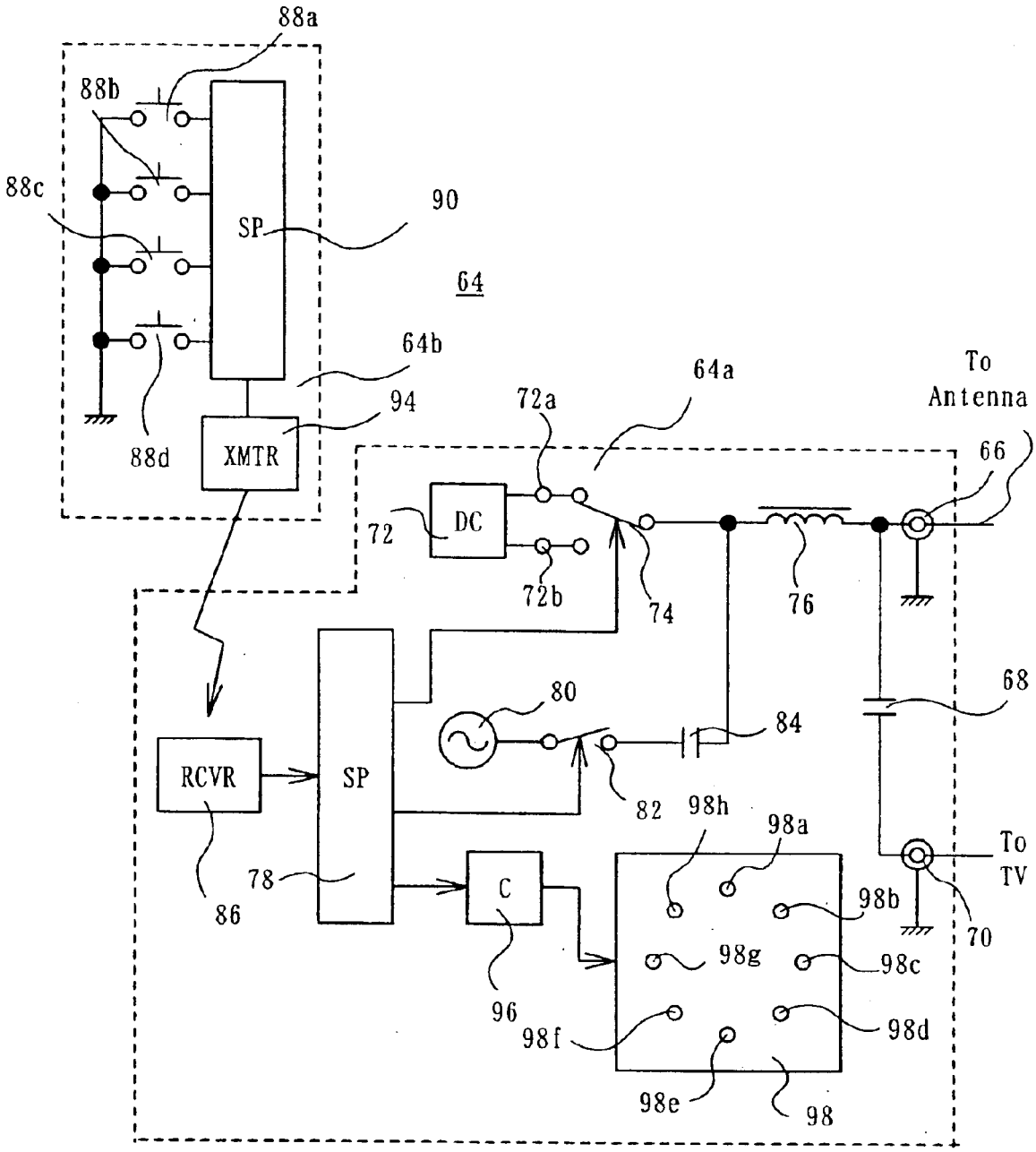
FIG. 2 is a block diagram of a remote control and an antenna controller which are used with the antennas shown in FIG. 1.

FIGS. 1 and 2 illustrate a receiving system in which the VHF antennas 22*a*–22*d* and the UHF antennas 8*a*–8*d* are used. FIG. 1 is a circuit diagram of circuitry is disposed in the body 2.

The UHF antenna 8*a* is connected to a high-pass filter 28 through a combination of a matching device 24*a* and selecting means, e.g. a switch 26*a*. Similarly, the UHF antennas 8*b*, 8*c* and 8*d* are connected to the high-pass filter 28 via respective combinations of matching devices 24*b*, 24*c* and 24*d* and switches 26*b*, 26*c* and 26*d*. Each of the switches 26*a*–26*d* is a semiconductor device, e.g. a PIN diode, which is closed when a selection control signal is applied to it and is open when no selection control signal is applied to it, as described later. The high-pass filter 28 has a cutoff frequency determined such that signals at frequencies not lower than the lowest frequency of, for example, the UHF television broadcast channels can pass therethrough.

Similarly, the VHF antennas 22*a*–22*d* are connected to respective ones of matching devices 30*a*, 30*b*, 30*c* and 30*d*, which, in turn, are connected to a low-pass filter 34 via associated ones of selecting means, e.g. switches 32*a*, 32*b*, 32*c* and 32*d*. The switches 32*a* through 32*d* are of the same type as the switches 26*a*–26*d*. The low-pass filter 34 has a cutoff frequency determined such that signals at frequencies not higher than the highest frequency of, for example, the VHF television broadcast channels can pass therethrough.

The outputs of the filters 28 and 34 are coupled to a terminal 38 through two paths 37*a* and 37*b* connected in parallel and a DC blocking capacitor 36. The terminal 38 is connected to later-mentioned operating means, e.g. an antenna controller 64, through a transmission line, e.g. a coaxial cable.

The path 37*a* includes a series combination of path opening-closing means, e.g. switches 40*a* and 40*b*. The switches 40*a* and 40*b* are arranged similarly to the switches 26*a* through 26*d*, in that when a closing signal is applied thereto they are closed, and when no closing signal is present, they are open. The other path 37*b* includes level adjusting means, e.g. a broadband amplifier 42 which can amplify all television signals in the UHF and VHF bands. The path 37*b* includes further path closing and opening means, e.g. switches 44*a* and 44*b* connected in the input and output sides of the amplifier 42, respectively. The switches 44*a* and 44*b* are arranged similarly to the switches 26*a* through 26*d* such that they are closed when a closing signal is applied thereto, and when no closing signal is present, they are open. The broadband amplifier 42 is automatic-gain-controlled so as to provide a constant output. The amplifier 42 operates when DC operating power, which is provided by a smoothing circuit (SM) 48, is coupled to it through a switch 46.

The smoothing circuit 48 is supplied with DC power from the antenna controller 64 through the terminal 38 and a high-frequency choke coil 50. The smoothing circuit 48 smoothes the supplied DC power and couples it to the switch 46. The smoothing circuit 48 supplies DC power to other active devices including a switch control circuit 54. The switch 46 is operated to couple operating power to the amplifier 42 in response to an output of a tone signal detector 52 developed when the tone signal detector 52 detects a tone signal.

When the tone signal detector 52 detects the tone signal, the switch control circuit 54 supplies the closing signal to the switches 44*a* and 44*b*, but not to the switches 40*a* and 40*b*. Thus, outputs of the high-pass filter 28 and the low-pass filter 34 are amplified by the amplifier 42 and then coupled to the terminal 38. When the tone signal detector 52 detects no tone signal, the switch control circuit 54 supplies no closing signal to the switch 44*a* or 44*b*, but supplies the closing signal to the switches 40*a* and 40*b*. Accordingly, an output of the high-pass filter 28 and an output of the low-pass filter 34 are coupled to the terminal 38 without being amplified. The tone signal is supplied from the antenna controller 64 to the tone signal detector 52 through a capacitor 56, the high-frequency choke coil 50 and the terminal 38.

As will be described in detail later, a pulse signal is supplied from the antenna controller 64 to the terminal 38, from which the pulse signal is coupled through the high-frequency choke coil 50 to a pulse detector 58. The number of pulses in the pulse signal are counted in a counter 60. The count in the counter 60 is supplied to a switch control circuit 62, which controls the switches 26*a*–26*d* and 32*a*–32*d*. The counter 60 counts a count 0 up to 7 and returns to a count 0.

Figure 3:
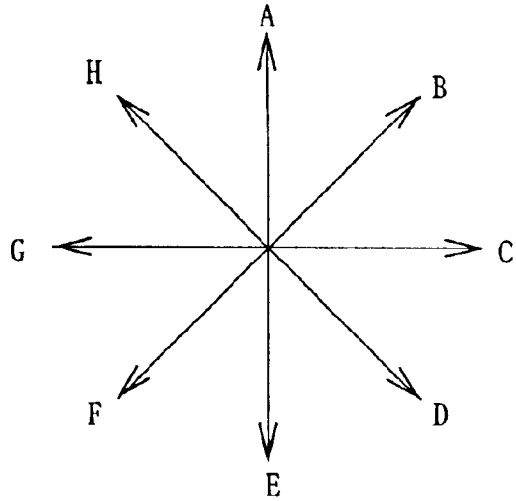
FIG. 3 illustrates the directions in which the directivity of the antenna system is changed.
Figure 4A:
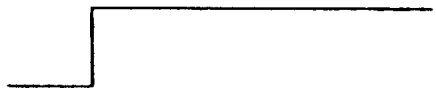
FIGS. 4(*a*) through 4(*f*) show waveforms at various portions of the antenna system of FIG. 1.
Figure 4B:
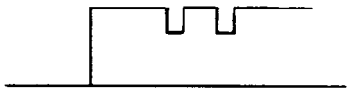
Figure 4C:
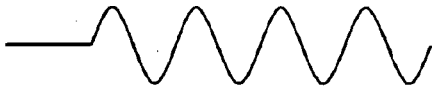
Figure 4D:
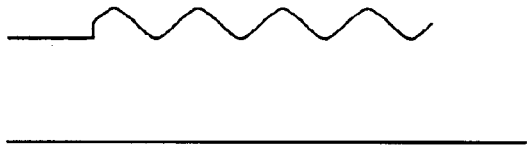
Figure 4E:
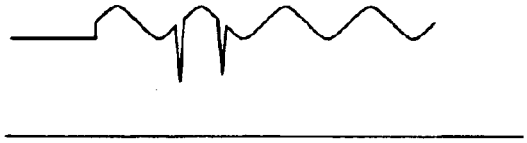
Figure 4F:
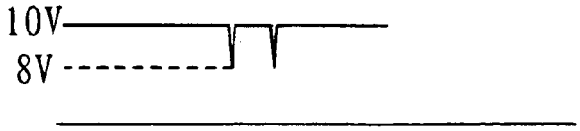

When, for example, the count in the counter 60 is "0", the switch control circuit 62 supplies the selection control signal only to the switches 26*a* and 32*a* to thereby couple the outputs of the antennas 8*a* and 22*a* to the terminal 38. Then, the maximum UHF and VHF antenna directional responses of the antenna system, i.e. the directivities of the antenna system for receiving radio waves in the UHF and VHF bands, are exhibited in a direction indicated by an arrow A in FIG. 3.

When the count in the counter 60 is "1", the switch control circuit 62 provides the selection control signal only to the switches 26*a*, 26*b*, 32*a* and 32*b*, so that the combination of the outputs of the antennas 8*a* and 8*b* and the combination of the outputs of the antennas 22*a* and 22*b* are coupled to the terminal 38. In this case, the UHF and VHF antenna directivities of the antenna system as a whole, are in a direction indicated by an arrow B in FIG. 3.

When the count in the counter 60 is "2", the switch control circuit 62 provides the selection control signal only to the switches 26*b* and 32*b*, so that the output signals of the antennas 8*b* and 22*b* are coupled to the terminal 38. In this case, the UHF and VHF antenna directivities of the antenna system are in a direction indicated by an arrow C in FIG. 3.

When the count in the counter 60 is "3", the switch control circuit 62 supplies the selection control signal only to the switches 26*b*, 26*c*, 32*b* and 32*c*, so that the combination of the outputs of the antennas 8*b* and 8*c* and the combination of the outputs of the antennas 22*b* and 22*c* are coupled to the terminal 38. Thus, the UHF and VHF antenna directivities of the antenna system are in a direction indicated by an arrow D in FIG. 3.

When the count is "4", the switch control circuit 62 supplies the selection control signal only to the switches 26*c* and 32*c*, and, therefore, the output signals of the antennas 8*c* and 22*c* are coupled to the terminal 38. Accordingly, the UHF and VHF antenna directivities of the antenna system are in a direction indicated by an arrow E in FIG. 3.

When the count in the counter 60 is "5", the switch control circuit 62 supplies the selection control signal to the switches 26*c*, 26*d*, 32*c* and 32*d*. Then, the combination of the outputs of the antennas 8*c* and 8*d* and the combination of the outputs of the antennas 22*c* and 22*d* are coupled to the terminal 38. Then, the UHF and VHF antenna directivities of the antenna system are in a direction indicated by an arrow F shown in FIG. 3.

The switch control circuit 62, when the count in the counter 60 is "6", supplies the selection control signal only to the switches 26*d* and 32*d* so that the output signals of the antennas 8*d* and 22*d* are coupled to the terminal 38. Accordingly, the UHF and VHF antenna directivities of the antenna system are in a direction indicated by an arrow G shown in FIG. 3.

When the count in the counter 60 is "7", the switch control circuit 62 supplies the selection control signal only to the switches 26*a*, 26*d*, 32*a* and 32*d*, so that the combination of the outputs of the antennas 8*a* and 8*d* and the combination of the outputs of the antennas 22*a* and 22*d* are coupled to the terminal 38. Then, the maximum UHF and VHF antenna directivities of the antenna system are in a direction indicated by an arrow H shown in FIG. 3.

As described, by controlling the switching of the switches 26*a*–26*d* and 32*a*–32*d*, either the output of one of the individual UHF antennas 8*a*–8*d* and the output of one of the individual VHF antennas 22*a*–22*d*, or the combination of the outputs of two of the individual UHF antennas 8*a*–8*d* and the combination of the outputs of two of the individual VHF antennas 22*a*–22*d* are coupled to the terminal 38. In this manner, a desired one of the eight (8) optimum directivities exhibited in the eight (8) directions about the body 2 for each of the UHF and VHF bands can be selected. The directivities provided for the antenna system by individual ones of the UHF antennas and individual ones of the VHF antennas are for receiving radio waves coming to the antenna system from the first directions A, C, E and G, and the directivities provided by combinations of two of the UHF antennas and combinations of two of the VHF antennas is for receiving radio waves coming from the second directions B, D, F and H.

FIG. 2 shows the antenna controller 64, which includes transmitting means, e.g. a controller unit 64*a*, and operating means, e.g. a remote control 64*b*.

The controller unit 64*a* has a terminal 66, which is connected to the terminal 38 on the body 2 through the coaxial cable, as described previously. The terminal 66 is connected via a capacitor 68 to a terminal 70, which, in turn, is connected to a television receiver via a coaxial cable. Thus, a signal received by the antenna system is supplied to the television receiver.

The controller unit 64*a* is provided with a DC operating power supply 72 for operating the components in the body 2 including the amplifier 42. The DC power supply 72 has terminals 72*a* and 72*b* at which two different voltages, e.g. voltages of 10 V and 8 V, are developed. A pulse generating switch 74 selects one of the two terminals 72*a* and 72*b*, and the selected terminal is connected through a high-frequency choke coil 76 to the terminal 66. Thus, when the pulse generating switch 74 is thrown to the terminal 72*a*, a DC voltage like the one shown in FIG. 4(*a*) is coupled to the body 2 for application to the amplifier 42 and other components within the body 2.

The pulse generating switch 74 is thrown to one of the terminals 72*a* and 72*b* in response to an opening-closing signal in the pulse form supplied thereto from a signal processing section (SP) 78. The signal processing section 78 switches the connection of the pulse generating switch 74 from the terminal 72*a* to the terminal 72*b*, and, after that, back to the terminal 72*a*, to thereby cause the counter 60 to count "1". In order to increase the count in the counter 60 to "2", the switch 74 is thrown to the terminal 72*b* from the terminal 72*a*, back to the terminal 72*a*, to the terminal 72*b*, again, and, then, back to the terminal 72*a*. In a similar manner, the pulse signal for the counter 60 is produced by switching the voltage from the DC power supply 72 between 10 V and 8 V. This pulsating opening-closing signal has a frequency of above, e.g. 400 KHz, and, the operation of the amplifier 42 is not affected by the change of the voltage from the DC power supply 72. FIG. 4(*b*) shows how the voltage of the DC power supply 72 is changed.

The controller unit 64*a* is provided therein with a tone signal generator 80, which generates a tone signal at a frequency of, e.g. 4 KHz, shown in FIG. 4(*c*). The tone signal is supplied through a switch 82, a capacitor 84, and a high-frequency choke coil 76, to the terminal 66. Accordingly, when the switch 82 is closed, the tone signal is superposed on the voltage from the DC power supply 72, as shown in FIG. 4(*d*). The superposed tone signal, then, is transmitted to the body 2, where it is detected by the tone signal detector 52. The opening-closing switch 82 is closed during a period while the closing signal is being applied to it from the signal processing section 78. FIG. 4(*e*) shows a voltage appearing at the terminal 38 as a result of superposing the tone signal on the DC voltage from the DC supply 72 while the DC voltage is being switched between 10 V and 8 V. FIG. 4(*f*) shows the voltage at the terminal 38 appearing when the tone signal is not superposed.

The signal processing section 78 controls the pulse generating switch 74 and the opening-closing switch 82 in accordance with an optical signal, e.g. an infrared signal sent from the remote control 64*b* and received by a signal receiving section (RCVR) 86.

The remote control 64*b* has four operating elements, e.g. push button switches 88*a*, 88*b*, 88*c* and 88*d*, which are connected to a signal processing section (SP) 90. In response to the operation of the switches 88*a*–88*d*, the signal processing section 90 causes an infrared signal to be transmitted from a signal transmitting section (XMTR) 94 to the receiving section 86 in the controller unit 64*a*.

The push button switch 88*a* is a switch for switching the directivity of the antenna assembly 1 in the body 2 in the counterclockwise. Each time the push button switch 88*a* is pressed, the pulse generating switch 74 is operated once by the signal processing section 78 in the controller unit 64*a*. In other words, the connection of the switch 74 is switches from a first terminal to the other and then returned to the first terminal. Accordingly, by pressing the switch 88*a* twice in succession, the pulse generating switch 74 is operated twice in succession. In other words, the connection of the switch 74 is switches from a first terminal to a second terminal, returned to the first terminal, switched to the second terminal again and, then, returned back to the first terminal.

The push button switch 88*b* is a switch for successively switching the directivity of the antenna assembly 1 and, hence, the antenna system, in the counterclockwise direction. Each time the push button switch 88*b* is pressed, the signal processing section 78 in the controller unit 64*a* causes the pulse generating switch 74 to be operated seven times, causing the count in the counter 60 to increment by seven. For example, if the count in the counter 60 increases by seven when the UHF and VHF antenna directivities (maximum UHF and VHF antenna directional responses) of the antenna system are in the direction A (FIG. 3), the directivities in the H direction are selected. Thus, by increasing the count in the counter 60 by seven, which is the total number, eight (8), of the selectable directivities of the antenna system minus one (1), the directivity is successively switched counterclockwise.

The push button switch 88*c* is used to operate the amplifier 42 in the antenna main body 2. Pressing the button switch 88*c* causes the signal processing section 78 to close the switch 82, which, in turn, causes the tone signal from the tone signal generator 80 to be sent to the main body 2, whereby operating power is supplied to the amplifier 42 and the switches 44*a* and 44*b* in the input and output sides of the amplifier 42, respectively, are closed, as described previously. If the push button switch 88*d* is pressed in this circuit state, the signal processing section 78 opens the switch 82 so that the tone signal is no longer transmitted. As a result, operating power is no longer supplied to the amplifier 42, the switches 44*a* and 44*b* are opened, and the switches 40*a* and 40*b* are closed instead.

The signal processing section 78 is arranged to generate an indication pulse signal, too, in response to the operation of the push button switches 88*a* and 88*b*. Pulses in the indication pulse signal are counted in a counter 96, and indication on an indicator 98 changes as the count changes. The indicator 98 has eight indicating elements, e.g. LEDs 98*a* through 98*h*, corresponding to respective ones of the selectable directivities of the antenna system. As the count in the counter 96 changes, a different one of the LEDs 98*a*–98*h* is activated to emit light. Thus, the direction in which the currently selected directivities of the antenna system are can be known.

With the above-described arrangement, the desired directivity of the antenna system can be freely selected by properly operating the push button switches 88*a* and 88*b* to thereby successively switch the directivity clockwise or counterclockwise. In addition, by properly pressing the switches 88*c* or 88*d*, the amplifier 42 in the main body 2 is enabled or disabled. If, for example, the level of a signal to be received is small, the amplifier 42 may be operated to provide a signal having an amplified magnitude. On the other hand, if the signal level amplified by the amplifier 42 is too large, the amplifier 42 is disabled. In the described example, the DC power supply 72 is arranged to provide two different-magnitude voltages, and the pulse signal is generated by switching between the two voltages. However, the DC power supply 72 may be arranged to provide, for example, one voltage, which is intermittently interrupted to provide a pulse signal.

Figure 10:
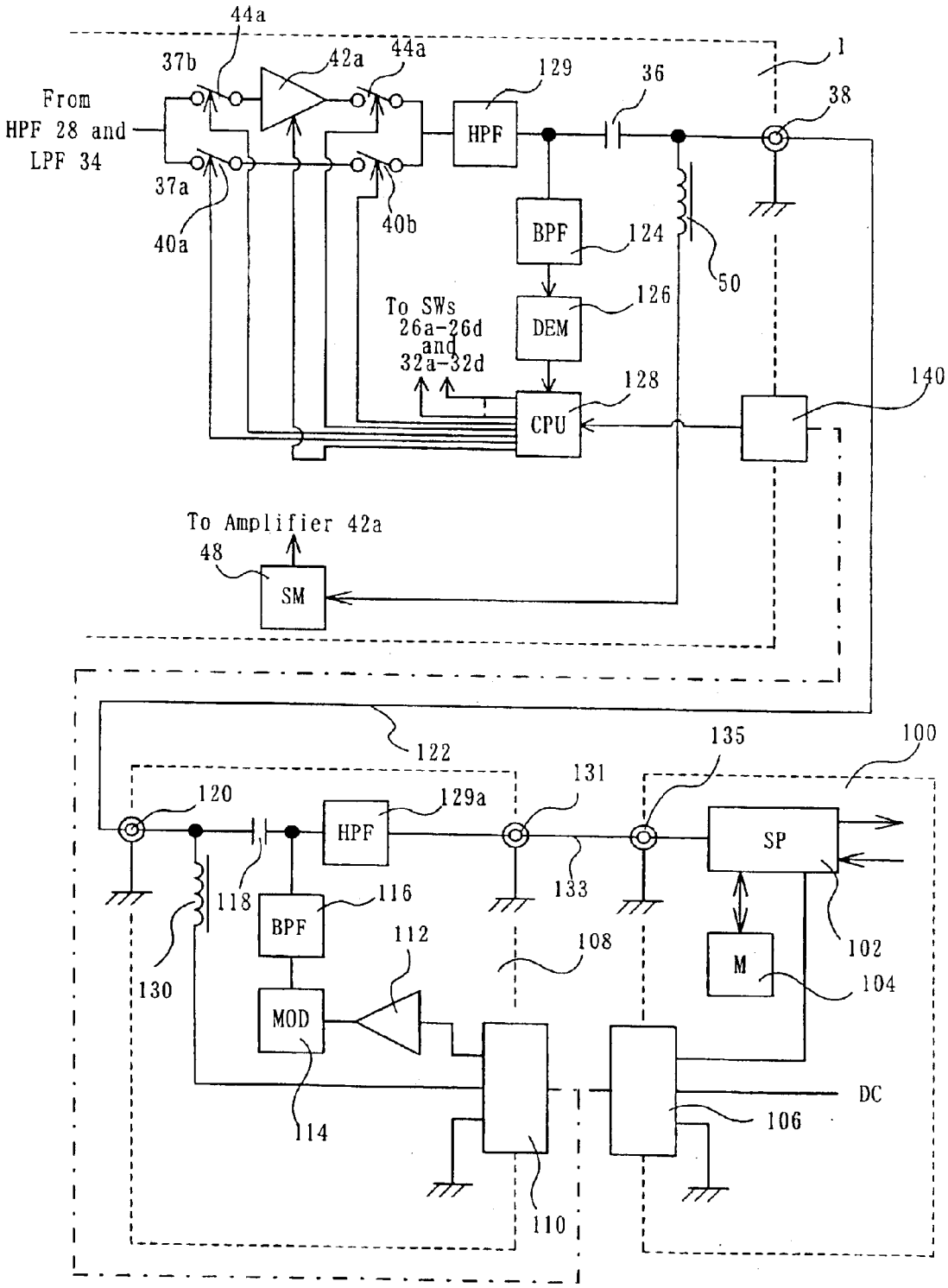
FIG. 10 is a block diagram of an antenna system according to a second embodiment of the present invention.

An antenna system according to a second embodiment is shown in FIG. 10. The antenna system according to the second embodiment includes an antenna main body 2 similar to the one described with reference to the first embodiment; and also a tuner 100.

The tuner 100 includes a signal processing section (SP) 102 which demodulates a desired one of the received UHF and VHF band television broadcast signals supplied thereto from the antennas. The tuner 100 includes also memory means, e.g. a memory (M) 104, in which data relating to the respective channels and associated direction data relating to the antenna directivity necessary for the respective receiving channels. When data of a desired channel is read out from the memory 104 so as to cause the signal processing section 102 to receive and demodulate the desired channel television signal, the direction data relating to the antenna directivity associated with the read out channel data is also read out. The read out direction data is supplied through a modular jack 106 to a modular jack 110 of an interface unit 108. The date from the modular jack 110 is supplied through a buffer 112 to a FSK (frequency-shift keying) modulator 114 where it is converted to a FSK modulated signal. The FSK modulated signal is then coupled to the terminal 38 on the main body 2, through a band-pass filter 116 which allows only the FSK modulated signal to pass therethrough, a DC blocking capacitor 118, a terminal 120, and a transmission path, e.g. a coaxial cable 122. The carrier of the FSK modulated signal has a lower frequency than UHF and VHF band television broadcast signals.

The FSK modulated signal is coupled from the terminal 38 through the DC blocking capacitor 36, and a band-pass filter 124 to a FSK demodulator 126, where the data is recovered. The recovered data is supplied to a CPU 128. The band-pass filter 124 has such a pass-band as to allow the FSK modulated signal to pass therethrough. In place of the band-pass filter 124, a low-pass filter having a cutoff frequency located between the highest frequency of the FSK modulated signal and the lower limit of the VHF band may be used. The switches 26*a*–26*d* and 32*a*–32*d* are switching-controlled in accordance with the recovered data, to select an optimum UHF or VHF antenna directivity for receiving the channel to be received. The signal received by the UHF or VHF antenna or antennas exhibiting the optimal directivity for that signal is coupled to the terminal 120 of the interface unit 108 through the path 37*a* or 37*b*, a high-pass filter 129, the DC blocking capacitor 36, the terminal 38 and the coaxial cable 122. The signal received at the terminal 120 of the interface unit 108 is coupled to a terminal 131 through a DC blocking capacitor 118, and a high-pass filter 129*a* which allows signals at frequencies above the VHF band to pass therethrough, and, then, coupled from the terminal 131 through a coaxial cable 133 and a terminal 135 of the tuner 100 to the signal processing section 102.

In place of the amplifier 42 used in the first embodiment, level adjusting means, e.g. a variable gain amplifier 42*a* is used in the main body 2. A DC operating power supply for the amplifier 42*a*, the demodulator 126 and the CPU 128 is disposed in the tuner 100. A DC operating voltage is supplied through the modular jacks 106 and 110 to the interface unit 108. The operating power is coupled through a high-frequency choke coil 130, the terminal 120 and the coaxial cable 122 to the terminal 38 of the body 2. The DC operating voltage coupled to the terminal 38 is supplied through the high-frequency choke coil 50 to the smoothing circuit 48 where it is smoothed and, then, applied to the amplifier 42*a*. The amplifier 42*a* is continuously operating. As in the first embodiment, however, the amplifier 42*a* may be arranged to be operated only when required, by operating the switch 46 or the like.

The amplifier 42*a* has its gain controlled in accordance with data provided by the tuner 100. The memory 104 in the tuner 100 stores therein not only the receiving channels and associated antenna directivities, but also data representing the gains to be set for the amplifier 42*a* for receiving particular channels. When the direction data is read out, the gain data is also read out. The gain data is sent to the CPU 128 in a manner similar to the one described with respect to the direction data. Upon receipt of the gain data, the CPU 128 sets the gain of the amplifier 42*a* to the one represented by the data and closes the switches 44*a* and 44*b*. If the gain data indicates that the signal should not be amplified, the CPU 128 opens the switches 44*a* and 44*b* and closes the switches 40*a* and 40*b*. When digital television broadcast signals are received, no gain control is done.

The antenna direction data and the gain data are included in one data stream including, for example, fourteen (14) bits. The data stream may be, for example, a Mode A 14-bit Serial Data Stream defined by EIA/CEA-909 standard. The data from the tuner 100 has been described to be applied to the antenna assembly 1 through the coaxial cable 122. Alternatively, the antenna assembly 1 may be provided with a modular jack 140, which is connected to the CPU 128, and also to the modular jack 106 through a cable.

With this arrangement, the selection of a desired channel automatically selects the optimum antenna directivity for the selected channel and also automatically sets the gain of the variable gain amplifier 42*a* to the predetermined gain for the selected channel.

Figure 11:
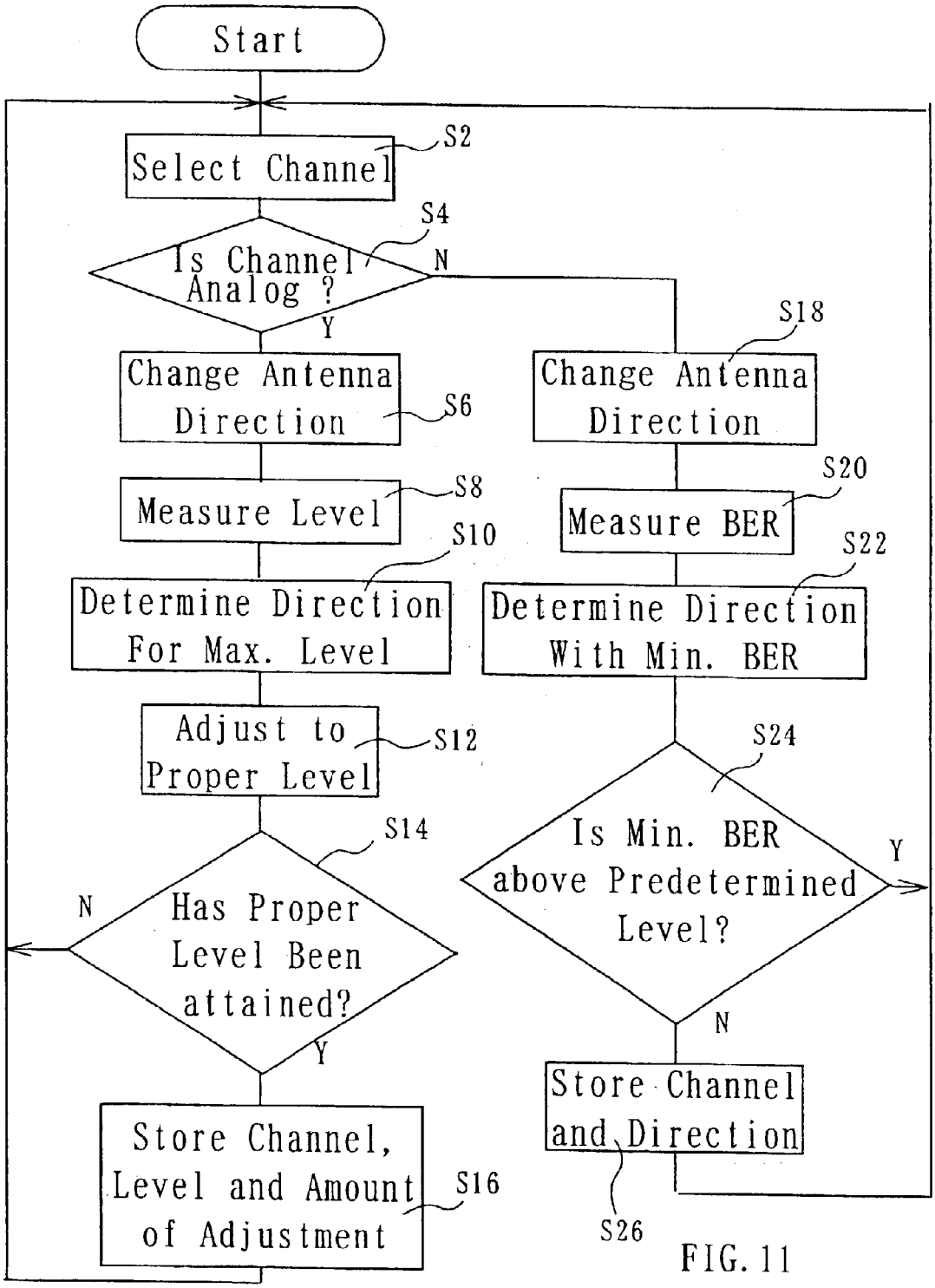
FIG. 11 is a flow chart for use in explaining the operation of a tuner unit of the antenna system shown in FIG. 10.

In order to perform the above-described control, it is necessary to store in the memory 104, the channels to be received, optimum directivities for the respective channels, and the gains of the variable gain amplifier 42*a* in a correlated fashion. To realize it, processing shown in FIG. 11 is done in the tuner 100. The tuner 100 is capable of receiving both analog and digital broadcast television signals.

First, the signal processing section 102 automatically selects a channel (Step S2). Next, whether the selected channel is an analog television broadcast channel or not is judged (Step S4).

If the selected channel is an analog television broadcast channel, the antenna directivity is successively switched (Step S6). The switching of the antenna directivity may be done by transmitting the directivity switching data from the signal processing section 102 to the antenna assembly 1. Each time the antenna directivity is changed, the received signal level is measured (Step S8), and the direction in which the maximum signal level is measured is determined (Step S10). As described previously, the gain adjusting data pieces are successively sent from the signal processing section 102 whereby the level of the signal received at the antenna assembly 1 in the determined direction is successively changed (Step S12). Then, whether or not there is a proper level among the resulting levels is judged (Step S14). If there is, the selected channel, the determined direction, and the gain which provides the proper signal level are correlated and stored in the memory 104 (Step S16). The procedure returns to Step S2, and the same processing is carried out for other channels. If it is judged in Step S14 that a proper signal level cannot be attained, which means that the reception of that channel is not possible, no data is stored in the memory 104, and the procedure returns to Step S2 for a next channel.

If it is judged in Step S4 that the selected channel is a digital television broadcast channel, the antenna directivity is successively switched as in Step S6 (Step S18). Each time the directivity is changed, a bit error rate (BER) is measured (Step S20), and the direction in which the minimum bit error rate among the measured ones is exhibited is determined (Step S22). Then, whether or not the minimum bit error rate is above a predetermined value is judged (Step S24). The minimum bit error rate above the predetermined value means that the selected digital television channel cannot received properly, no data is stored in the memory 104, but the procedure returns to Step S2 for another channel. On the other hand, if the minimum bit error rate is below the predetermined value, which means that the selected channel can be received properly, the selected channel and the determined direction are correlated and stored in the memory 104. In this case where the bit error rate is measured, too, it may be arranged that the gain of the amplifier 42*a* be adjusted.

As described above, according to the second embodiment, the antenna directivity and the gain of the amplifier 42*a* can be automatically and simultaneously adjusted for a particular selected channel.

In the described antenna systems according to the embodiments of the present inventions, four antennas are used for each of the UHF and VHF bands so that the antenna directivity can be selected from eight directivities in eight directions. However, a larger number of antennas may be used and combined to provide a larger number of directivities.

According to the first embodiment, in order to search for an optimum directivity of the UHF and VHF antennas for a particular signal by successively switching the directivities in a direction opposite to a previous switching direction, seven pulses are supplied to the counter 60. As an alternative, the counter 60 may be replaced by an up-down counter, which is operated as an up-counter for switching the directivity in, for example, the clockwise direction, and as a down-counter for switching the antenna directivity in the counterclockwise direction.

According to the second embodiment, the variable gain amplifier 42*a* is used as the level adjusting means, but a variable attenuator may be used instead. Also, in the second embodiment, the interface unit 108 is used as a discrete component, but it may be incorporated in the tuner 100.

According to the second embodiment, the FSK modulator 114 and the FSK demodulator 126 are used, but an ASK (Amplitude-Shift Keying) modulator and an ASK demodulator may be used instead.

What is claimed is:

1. An antenna system comprising:

an antenna main body;

a plurality of first antennas disposed within said main body in such a manner as to provide with said antenna system with a plurality of directivities that enable said antenna system to receive radio waves in a first frequency band coming to said main body from a plurality of first different directions around said main body, said antennas being able to be combined to provide said antenna system with a plurality of directivities that enables said antenna system to receive radio waves in said first frequency band coming to said main body from a plurality of second different directions between adjacent ones of said first directions;

first selecting means disposed within said main body for selecting one of outputs provided by individual ones of said first antennas and combinations of said first antennas; and control means formed as a unit separate from said main body, said control means providing a selection control signal to said first selecting means;

said control means including first and second operating elements, and providing said first selecting means with such selection control signal as to successively scan said directivities of said antenna system in a clockwise direction around the main body each time said first operating element is operated, and with such selection control signal as to successively scan said directivities of said antenna system in the counterclockwise direction around said antenna main body each time said second operating element is operated.

2. The antenna system according to claim 1 wherein level adjusting means is disposed in said antenna main body for adjusting a level of an output of individual one or combinations of said first antennas selected by said first selecting means; and said control means further includes a third operating element, said control means providing said level adjusting means with a signal commanding said level adjusting means to operate in a state represented by said signal.

3. The antenna system according to claim 2 further comprising a transmission path between said main body and said control means, through which one of outputs provided by individual ones of said first antennas and combinations of said first antennas is transmitted from said main body to said control means and through which an operating voltage for said level adjusting means is supplied from said control means to said main body; said control means supplying said selection control signal in a form of variations of said operating voltage.

4. The antenna system according to claim 3 wherein said control means sends through said transmission path a tone signal as said signal indicating operation of said level adjusting means.

5. The antenna system according to claim 3 wherein said control means includes pulse generating means generating a pulse in response to operation of said first and second operating elements, counting means counting said pulse, and selecting means controlling means generating said selection control signal in accordance with a count in said counting means; said pulse generating means generating one pulse each time said first operating element is operated and generating a plurality of pulses each time said second operating element is operated, said plurality being equal to the sum of the numbers of said first and second directions less one.

6. The antenna system according to claim 1 wherein said control means includes operating means for transmitting an optical signal in response to operation of said operating elements, and transmitting means separate from said operating means and receiving said optical signal for supplying said selection control signal to said antenna main body.

7. The antenna system according to claim 1 further comprising:

a plurality of second antennas disposed within said main body in such a manner as to provide with said antenna system with a plurality of directivities that enable said antenna system to receive radio waves in a second frequency band coming to said main body from a plurality of first different directions around said main body, said antennas being able to be combined to provide said antenna system with a plurality of directivities that enables said antenna system to receive radio waves in said second frequency band coming to said main body from a plurality of second different directions between adjacent ones of said first directions; and second selecting means disposed within said main body for selecting one of outputs provided by individual ones of said second antennas and combinations of said second antennas;

said control means providing, for said first and second selecting means, such selection control signals as to successively scan said directivities of said antenna system in the clockwise direction around the main body each time said first operating element is operated, and providing such selection control signals as to successively scan said directivities of said antenna system in the counterclockwise direction around said antenna main body each time said second operating element is operated.

8. The antenna system according to claim 1 wherein said control means includes pulse generating means generating a pulse in response to operation of said first and second operating elements, counting means counting said pulse, and selecting means controlling means generating said selection control signal in accordance with a count in said counting means; said pulse generating means generating one pulse each time said first operating element is operated and generating a plurality of pulses each time said second operating element is operated, said plurality being equal to the sum of the numbers of said first and second directions less one.

9. An antenna system comprising:

an antenna main body;

a plurality of antennas disposed within said main body in such a manner as to provide with said antenna system with a plurality of directivities that enable said antenna system to receive radio waves coming to said main body from a plurality of first different directions around said main body, said antennas being able to be combined to provide said antenna system with a plurality of directivities that enables said antenna system to receive radio waves coming to said main body from a plurality of second different directions between adjacent ones of said first directions;

selecting means disposed within said main body for selecting respective ones of outputs provided by individual ones of said antennas and combinations of said antennas, in response to associated ones of selection control signals supplied thereto; and a tuner formed as a unit separate from said main body for receiving and demodulating an output provided from said selecting means;

said tuner including memory means having stored therein said selection control signals to be supplied to said selecting means for selectively receiving radio waves of a plurality of broadcast channels to be received, said tuner, when any one of the broadcast channels is selected, reading out of said memory means, the selection control signal associated with said selected broadcast channel and supplying a read out selection control signal to said selecting means.

10. The antenna system according to claim 9 further comprising:

level adjusting means disposed in said main body for adjusting a level of the output provided by one of said antennas or a combination of said antennas selected by said selecting means;

said memory means having stored therein, in addition to said selection control signals, level control signals indicating operating states to be assumed by said level adjusting means, said operating states being associated with respective ones of said broadcast channels to be received;

said tuner, when any one of said broadcast channels is selected, reading out of said memory means, the level control signals associated with said selected broadcast channel and supplying a read out level control signal to said level adjusting means.

11. The antenna system according to claim 9 wherein said respective selection control signals are formed in accordance with bit error rates produced by said tuner when said broadcast channels are digital television broadcast channels, and are formed in accordance with signal receiving levels in said tuner when said broadcast channels are analog television broadcast channels.

12. The antenna system according to claim 9 wherein said tuner sends said selection control signals to said main body through a transmission path between said main body and said tuner through which an output provided by one of said antennas or a combination of said antennas is sent from said main body to said tuner.

* * * * *